United States Patent [19]

Bowers

[11] 4,226,396

[45] Oct. 7, 1980

[54] UNIVERSAL SHADE BRACKET

[75] Inventor: Michael J. Bowers, Cedarville, Ill.

[73] Assignee: Newell Companies, Inc., Freeport, Ill.

[21] Appl. No.: 22,425

[22] Filed: Mar. 21, 1979

[51] Int. Cl.[3] ..... A47H 1/10; E06B 9/17

[52] U.S. Cl. ..... 248/268; 248/254

[58] Field of Search ..... 248/251, 267, 261, 262, 248/266, 268, 269, 252, 254, 255, 257, 300

[56] References Cited

U.S. PATENT DOCUMENTS

| | | | |
|---|---|---|---|
| 343,483 | 6/1886 | McGuire | 248/267 |
| 373,674 | 11/1887 | McGuire | 248/267 |
| 812,262 | 2/1906 | Dunkle | 248/252 |
| 1,253,373 | 1/1918 | Graham | 248/267 |
| 2,396,572 | 3/1946 | Hartman | 248/252 |
| 2,706,100 | 4/1955 | Thomason | 248/255 |

*Primary Examiner*—J. Franklin Foss

[57] ABSTRACT

A universal shade bracket which is (i) capable of receiving and supporting either the round pin end or the flattened pin end of a window shade assembly, and equally (ii) capable of supporting the window shade assembly from any one of the three conventional support surfaces; i.e.: a surface perpendicular to the axis of the window shade assembly, a surface vertically parallel to the axis of the window shade assembly, and a horizontal surface located above the window shade assembly.

2 Claims, 3 Drawing Figures

UNIVERSAL SHADE BRACKET

This invention relates to window furnishings hardware, and specifically to window shade brackets.

Window shade brackets currently available are generally sold in pairs, each individual bracket in a pair usually being a reverse image of the other bracket of the pair, to some extent at least, since one bracket is constructed to receive only the flatted roller pin which projects from one end of a window shade roller, and the other bracket is constructed to receive only the round roller pin which projects from the other end of the window shade roller which is to be supported from the pair of brackets. Thus, each bracket is dissimilar in construction to the other bracket of the pair.

As a result most bracket manufacturers are required to manufacture two dissimilar products. This generally substantially increases manufacturing costs, such as tooling, and creates potential manufacturing and packaging difficulties. For example, if two separate lines are operating, one for each dissimilar bracket configuration, and one line is shut down, production eventually stops even though one line is in good working order. Further, special care must be taken to ensure that one, and only one, bracket of each design is eventually packages, and this can, depending of course on the production process engineered in any particular manufacturing plant, increase costs due to the need for special packaging machinery, and higher inspection standards.

The conventional dissimilar shaped brackets often pose a problem for the homeowner who wishes to install a pair of brackets. Often he must take care, when wall mounting a set of brackets, to make sure that the bracket designed to be placed on the left side of the window is mounted on the left side, and the right bracket on the right side, since the brackets are not interchangeable.

And further, some designs of mounting brackets are capable of being mounted only to a vertical surface, such as a wall or vertical casement surface, and another, quite dissimilar type of bracket must be separately purchased for ceiling or overhead mounting.

Accordingly the primary object of this invention is to provide a window shade bracket of a single design which can be universally mounted; that is, it may be mounted on a vertical surface such as a wall, or a horizontal surface, such as a ceiling.

A further object is to provide a window shade bracket which, in addition to the foregoing, can be mounted on a base surface, the plane of which is either parallel or perpendicular to the axis of the window shade which is to be supported.

Yet another object is to provide a window shade bracket as described above which eliminates all of the disadvantages in manufacturing, marketing and installation mentioned above.

The bracket which is the subject of this invention is a structure capable of being mounted on either a vertical or horizontal base or mounting surface (sometimes hereafter referred to as a universal bracket), and yet which consists of only a single piece of metal or other suitable material, which material may be easily formed by a single, or only a few, shaping operations, and yet which is equally suitable for both heavy duty and light weight shades.

Other objects and advantages of the invention will become apparent from a reading of the description of the invention contained herein.

The invention is illustrated more or less diagrammatically in the company drawing wherein.

Like reference numerals will be used to refer to like components and features from Figure to Figure in the drawing.

Figure 1:
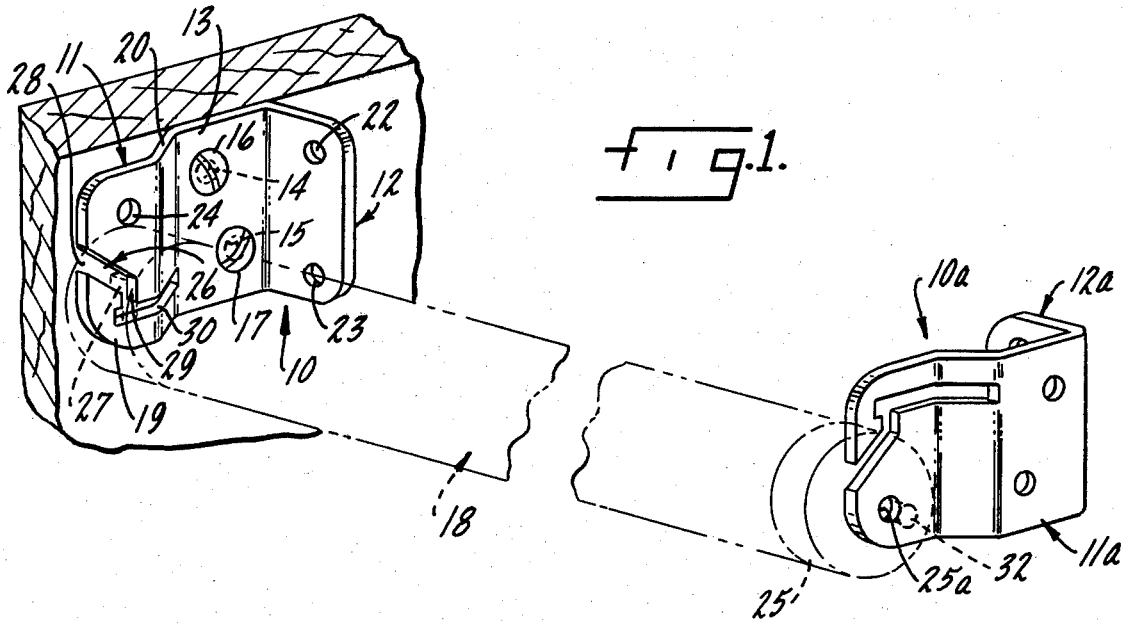
FIG. 1 is a perspective view of a pair of the identically contoured brackets of this invention, shown installed on a vertical base surface, such as a window casement surface, the plane of which base surface is perpendicular to the longitudinal axis of the window shade assembly.
Figure 2:
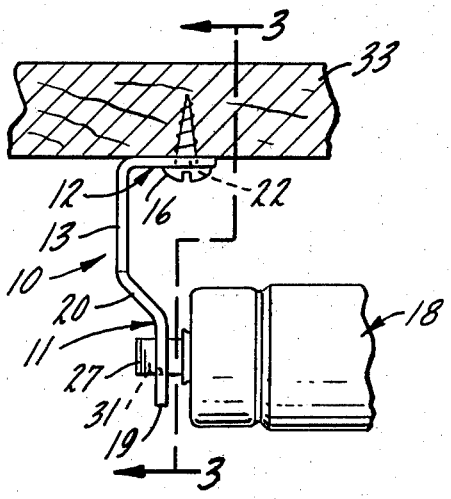
FIG. 2 is an edge view showing the bracket of this invention mounted to a horizontal surface, such as a ceiling or the lower face of the top end of a window casement surface.

Referring first to FIG. 1, the bracket which is the subject of this invention is illustrated at 10 and 10*a*. As best seen in FIGS. 1 and 2, the bracket includes an elongated body section, indicated generally at 11, and a shorter body section, indicated generally at 12, the elongated section 11 and shorter section 12 forming a generally L-shaped configuration. Body section 11 includes mounting portion 13, which contains a pair of holes 14, 15, adapted to receive mounting fasteners 16, 17, such as wood or plaster gripping screws. From FIG. 1 it will be noted that mounting portion 13 is disposed substantially perpendicularly to the axis of a window shade assembly, which assembly is indicated generally at 18. A pin portion is indicated at 19, the pin portion being spaced from mounting portion 13 by offset portion 20 whereby space is provided to receive the flattened end of the pin of the shade roller to be described in more detail hereinafter.

The shorter, angled section 12 includes a pair of mounting holes 22, 23.

Pin portion 19 includes a round hole 24 which is of a size sufficient to loosely receive the pin which projects outwardly from one end of a roller 25 in window shade assembly 18. The pin portion 19 further includes a mounting slot 26 which is constructed to receive and retain, after reception, the flattened end 27 of a window shade roller pin.

Figure 3:
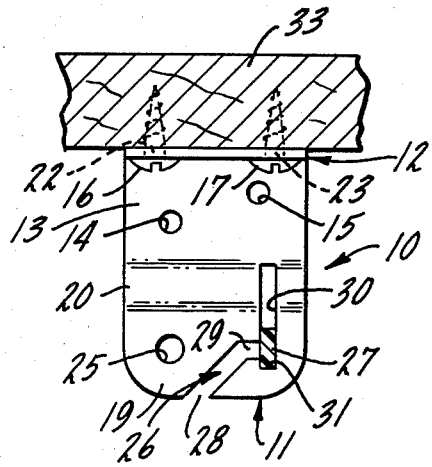
FIG. 3 is a view taken substantially along the line 3—3 of FIG. 2.

As can be best visualized from FIGS. 1 and 3, the mounting slot 26 includes an outside access slot portion 28 which opens into a first retaining slot section 29, which in turn opens into a second retaining slot section 30, the latter being perpendicularly oriented with respect to first retaining slot section 29.

It will be noted that the second retaining slot section 30 includes a well or seat portion 31 so that when the bracket is installed in the position of FIG. 3, the flattened end 27 will be retained in the illustrated vertical position.

As best seen in FIG. 3, the second retaining slot section 30 is considerably longer in length than the long dimension of the flattened pin 27 so that, if necessary, the pin can be inserted into slot section 30 by a swinging motion, through an arc which is generally parallel to the long dimension of slot section 30, and not through access slot 28.

It will be noted from FIG. 1 that the right bracket 10*a* has been rotated 180 degrees as contrasted to left bracket 10 so that the shorter, angled portion 12*a* opposes the corresponding angled or flanged portion 12 of left bracket 10. This rotation places round pin hole 25*a* of bracket 10*a* at a level which corresponds to the level of first retaining slot section 29 of bracket 10, so that when round pin 32 of the window shade roller is inserted in round pin hole 25*a*, the window shade assembly 18 will be disposed horizontally with respect to a horizontal, base reference line.

FIGS. 2 and 3 illustrate an alternative mounting arrangement in that the mounting screws 16, 17 are received in mounting holes 22, 23 in the flange or shorter angled portion 12 of bracket 10. This arrangement is used when the mounting structure 33 is located parallel to the plane of flange portion 12 and 12*a*.

In the mounting arrangement illustrated in FIGS. 2 and 3, it will be noted that pin 27 is again, as in FIG. 1, vertically oriented which is the preferred orientation for the flattened end of the pin.

It will be noted from an examination of the mounting bracket 10 that it is of one-piece construction and can be easily and rapidly manufactured by conventional, inexpensive bending and shaping processes followed, or preceded, by a punching operation to form the openings.

It will furthermore be appreciated that the brackets can be installed on either vertical or horizontal surfaces and, no matter which type of surface it is installed upon, the flattened pin of the window shade assembly will always be retained in a vertical position, which is the preferred installation position. Furthermore, the brackets will always face inwardly in the sense that the flange or shorter portions 12, 12*a* will always oppose one another so that the more asthetically pleasing smoother surface represented by the outside face of elongated body section 11 or 11*a* will be visable to the observer.

It will further be noted that access to the mounting slot 26 is easily and conveniently obtained by reason of the elongation of the second retaining slot section 30, and the outside access slot 28.

Although a preferred embodiment of the invention has been illustrated and described, it will be understood by those skilled in the art that various modifications and improvements may be made in the structure disclosed without departing from the spirit and scope of the invention.

Accordingly it is intended that the scope of the invention be limited not by the foregoing exemplary disclosure, but solely by the scope of the hereafter appended claims when interpreted in light of the pertinent prior art.

I claim:

1. A one-piece, universal shade mounting bracket capable of supporting either end of a window shade assembly from a base structure whose mounting surface is above, perpendicular to, or vertically parallel to the axis of said window shade assembly, said bracket including an elongated first body section, said elongated body section being substantially longer than it is wide, and substantially wider than it is thick, a second body section, said second body section extending generally perpendicularly outwardly from the elongated first body section at one end of said elongated first body section, the thickness of said second body section being dimensionally substantially less than its length or width, each of said body sections having aperture means therein constructed and arranged to receive fastening means for securing the bracket to a base structure whose mounting surface is above, perpendicular to, or vertically parallel to the axis of said window shade assembly, the end of the elongated body section opposite the end of said elongated body section which is integral with the second body section having first and second pin receiving apertures, one of said pin receiving apertures being constructed and arranged to loosely, but restrainedly, receive the round end of a window shade assembly, the other of said pin receiving apertures being constructed and arranged to receive the flattened pin of a window shade assembly, said pin receiving apertures being so arranged that the flattened pin of the window shade assembly is always disposed in a vertical position irrespective of the orientation of the base surface to which the bracket is fastened.

2. The bracket of claim 1 further characterized in that said end of the elongated body section which carries the pin receiving apertures is offset from that portion of the elongated body section which is next adjacent the second body section, said offset end being offset in the same direction as the free, unconnected end of the second body section, whereby the bracket can be mounted to a planar base surface which is disposed parallel to the plane of the offset portion of the elongated body section.

* * * * *